US006567629B2

(12) United States Patent
Anderson et al.

(10) Patent No.: US 6,567,629 B2
(45) Date of Patent: May 20, 2003

(54) COOLING DEVICE FOR IMAGING APPARATUS

(75) Inventors: Bradley J. Anderson, Boise, ID (US); Bruce L. Johnson, Eagle, ID (US); William I. Herrmann, Eagle, ID (US); Courtney A. Fortier, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/859,857

(22) Filed: May 16, 2001

(65) Prior Publication Data

US 2002/0172524 A1 Nov. 21, 2002

(51) Int. Cl.[7] ..... G03G 21/20
(52) U.S. Cl. ..... 399/92; 347/155; 399/401
(58) Field of Search ..... 399/92, 405, 406, 399/407, 308, 401; 347/155, 156; 219/388; 118/60, 69, 101

(56) References Cited

U.S. PATENT DOCUMENTS 5,089,857 A * 2/1992 Xydias ..... 399/401
5,210,580 A * 5/1993 Aslam et al. ..... 399/328
5,557,388 A * 9/1996 Creutzmann et al. ..... 399/92
5,676,754 A * 10/1997 Helms et al. ..... 118/101
5,805,969 A * 9/1998 Elsermans et al. ..... 399/341

FOREIGN PATENT DOCUMENTS

| | | |
|---|---|---|
| JP | 1-266557 | * 10/1989 |
| JP | 404143785 | * 5/1992 |
| JP | 410090965 | * 4/1998 |
| JP | 2000187417 | * 7/2000 |

* cited by examiner

*Primary Examiner*—Hoan Tran

(57) ABSTRACT

Apparatus and methods for cooling a sheet of media in an imaging apparatus wherein an image is deposited on, and fused to, the sheet of media. The sheet of media is cooled before the media exits the imaging apparatus. The apparatus includes a cooling surface configured to contact the sheet of media whereupon heat energy is transferred from the relatively hot sheet of media to the cooling surface which can act as a heat sink to dissipate heat energy. Other devices such as fans, cooling fins, coolant circulation systems and the like can be employed by the apparatus to further facilitate dissipation of the heat energy from the cooling surface.

9 Claims, 6 Drawing Sheets

COOLING DEVICE FOR IMAGING APPARATUS

FIELD OF THE INVENTION

This invention pertains to imaging apparatus and methods and more particularly, to apparatus and methods for cooling a sheet of media in an imaging apparatus.

BACKGROUND OF THE INVENTION

Various types of prior art imaging apparatus have been in use. By "imaging apparatus" we mean an apparatus that is configured to produce a given image on a sheet of media. Imaging apparatus include such devices known as printers, copiers, fax machines, and plotters. By "image" we mean to include any image, such as photographs, drawings, symbols, text, or any combination thereof, which is formed by depositing at least one shade or color of pigment onto a sheet of media. By "media" we mean any material onto which pigment can be affixed so as to form an image, including paper and plastic transparencies. That is, an image can range from simple black text on a white sheet of paper media to a complex color photograph on a transparency.

It is understood, then, that many different specific configurations of imaging apparatus exist. One such configuration of an imaging apparatus is that which is generally known as a laser printer. Referring now to FIG. 1, a schematic side elevation diagram is shown which depicts some of the basic components of a prior art laser printer apparatus 10. The prior art laser printer apparatus 10 comprises an infeed tray 22 and an outfeed tray 24. The infeed and outfeed trays 22, 24 are each configured to support at least one sheet of media "M."

The prior art laser printer apparatus 10 also comprises a set of infeed rollers 14 which are configured to feed a given sheet of media "M" along a media path "P" in the feed direction "D." As is seen, the prior art apparatus comprises an image-producing portion 12 which, in turn, generally comprises at least one laser device and one photoconductor surface (not shown). The image-producing portion 12 is configured to apply toner (not shown), which is in a substantially powdered form, to a sheet of media "M" in order to form an image thereon, while the sheet of media passes by the image-producing portion along the media path "P." Laser printers are known in the art and, therefore the process of forming an image on a sheet of media by employing a laser device and photoconductor will not be discussed in further detail herein.

As is further evident from a study of FIG. 1, the prior art apparatus 10 comprises a fusing portion 16. The fusing portion 16 is configured to heat the media "M," along with the toner supported thereon, to a given temperature in order to set, or "fuse," the toner to the media. That is, generally the powdered toner, which is supported on a sheet of media "M," is heated by the fusing portion 16 so that the toner is "melted" from its initial powdered form to a substantially "plastic" consistency. This fusing process in which the toner is substantially melted causes the toner to be substantially bonded to the media so as to form the final product of an image bonded to a sheet of media. During this fusing process, the temperature of the media "M" can reach significant levels and can be at least as high as 190°, Centigrade.

As is also seen, a set of outfeed rollers 18 is included in the prior art apparatus 10. The outfeed rollers 18 move the media "M," after it has passed the fuser 16, into the outfeed tray 24. The media "M" which is supported in the outfeed tray 24 is generally accessible to users of the apparatus 10 so that the sheets of media "M," which now support finished images, can be retrieved by the users of the apparatus 10. The location of the fusing portion 16 is generally fixed relative to the set of outfeed rollers 18. That is, a given fixed distance "L" is defined along the media path "P" between the fusing portion 16 and the set of outfeed rollers 18.

It is evident, then, that a given period of time which elapses between the moment at which a given sheet of media "M" passes through the fusing portion 16 and the moment at which the given sheet of media "M" passes through the set of outfeed rollers 18 is inversely proportional to the feed rate of the media along the feed path "P."In other words, faster feed rates, or production rates, will result in shorter elapsed times from the moment the media "M" passes through the fusing portion 16 and the moment at which the media is available for retrieval by the users of the apparatus 10.

Moving now to FIG. 2, a flow chart 30 is shown which depicts a set of prior art steps which can be used to describe the typical operational processes performed on a given sheet of media by the prior art laser printer apparatus 10 during the production of a finished image. The various steps of which the flow chart 30 is comprised will now be discussed with reference to both FIGS. 1 and 2. As is evident, the step S32 serves as the beginning of the flow chart 30. Moving on from step S32, the first operational step is that of S34. In accordance with step S34, a sheet of media "M" is taken from the infeed tray 22 and fed into the infeed rollers 14 so as to commence the movement of the media along the media path "P" and in the feed direction "D."

Moving to the next step, that of S36, the sheet of media "M" is fed past the image-producing portion 12, and an image comprising toner is deposited on the media by the image-producing portion. In accordance with the following step S38, the sheet of media "M" is fed past the fusing portion 16, and the toner and media is heated by the fusing portion to a relatively high temperature in order to fuse the image to the media. The next step of S40 includes passing the sheet of media "M" through the outfeed rollers 18, and depositing the media in the outfeed tray 24. The step S42 denotes the end of the flow chart 30. As discussed above, the production rate of the prior art apparatus 10 is limited by the need to provide ample time for the media "M" to cool after passing through the fusing portion 16 and before passing through the outfeed rollers 18 and into the outfeed tray 24.

Briefly referring again to FIG. 1, it is evident that at relatively high feed rates, the media "M" has correspondingly less time to cool before exiting the apparatus 10 through the set of outfeed rollers 18. This can result in the exposure of users of the apparatus 10 to media "M" which is at dangerously high temperatures, which can cause severe burns. In addition, stacked sheets of media "M" which accumulate in the outfeed tray can contain high levels of heat energy which can cause damage to the media and to the apparatus 10, and can also pose a potential fire hazard.

Furthermore, when a media such as plastic transparencies are used in the apparatus 10, the cumulative heat energy which is present in a stack of such transparencies can cause one sheet of media to fuse to another sheet. Therefore, feed rates of prior art imaging apparatus, such as the prior art laser printer apparatus 10, are often limited by the need to allow the media "M" to cool sufficiently before being made available in the outfeed tray 24.

What is needed then, are imaging apparatus and methods which achieve the benefits to be derived from similar prior art devices, but which avoid the shortcomings and detriments individually associated therewith.

SUMMARY OF THE INVENTION

The invention includes apparatus and methods for cooling a sheet of media on which an image is deposited in an imaging process. Typically, such imaging processes involve heating the media to a relatively high temperature for fusing the image to the media. The instant invention includes various embodiments thereof which are configured to actively reduce the temperature of the media before the media exits the imaging apparatus.

In accordance with a first embodiment of the present invention, an imaging apparatus comprises a cooling surface which is configured to contact a sheet of media and to thereby absorb heat energy there from. The cooling surface can be configured to act as a heat sink to absorb spikes of heat energy from a succession of sheets of media. The heat energy thereby absorbed from the sheets of media can then be passively dissipated from the cooling surface to the surrounding atmosphere by natural convection, for example. The heat energy can also be actively dissipated from the cooling surface using various devices which are configured to facilitate such heat dissipation. The cooling surface can be substantially flat, substantially cylindrical, or can have other shapes.

In accordance with a second embodiment of the present invention, an imaging apparatus includes a cooling device, a cooling surface defined on the cooling device, and a fan assembly configured to induce a stream of air to flow relative to the cooling device. The air can be made to flow substantially across the media and can also be made to flow substantially across the cooling surface. The cooling device can be in the form of a substantially cylindrical roller. The cylindrical roller can be substantially hollow so as to define a cavity there in which allows air to circulate through the roller to facilitate cooling thereof.

In accordance with a third embodiment of the present invention, a method of cooling a sheet of media includes providing a cooling surface, contacting the sheet of media to the cooling surface, and transferring heat energy from the sheet of media to the cooling surface. The method can also include dissipating the heat energy from the cooling surface to the atmosphere.

DETAILED DESCRIPTION OF THE INVENTION

The invention includes methods and apparatus for cooling a sheet of media before the media exits an imaging apparatus wherein an image is deposited on, and fused to, the sheet of media. The apparatus includes a cooling surface which can be defined on a cooling device such as a cylindrical roller or the like. The apparatus can also include a fan assembly which is configured to cause air to flow substantially across the media and the cooling surface for convective cooling thereof. Other devices and features can also be employed in conjunction with the cooling surface to facilitate removal and dissipation of heat energy from both the media and the cooling surface in pursuit of a reduction in the temperature of the media as described further below.

Figure 1:
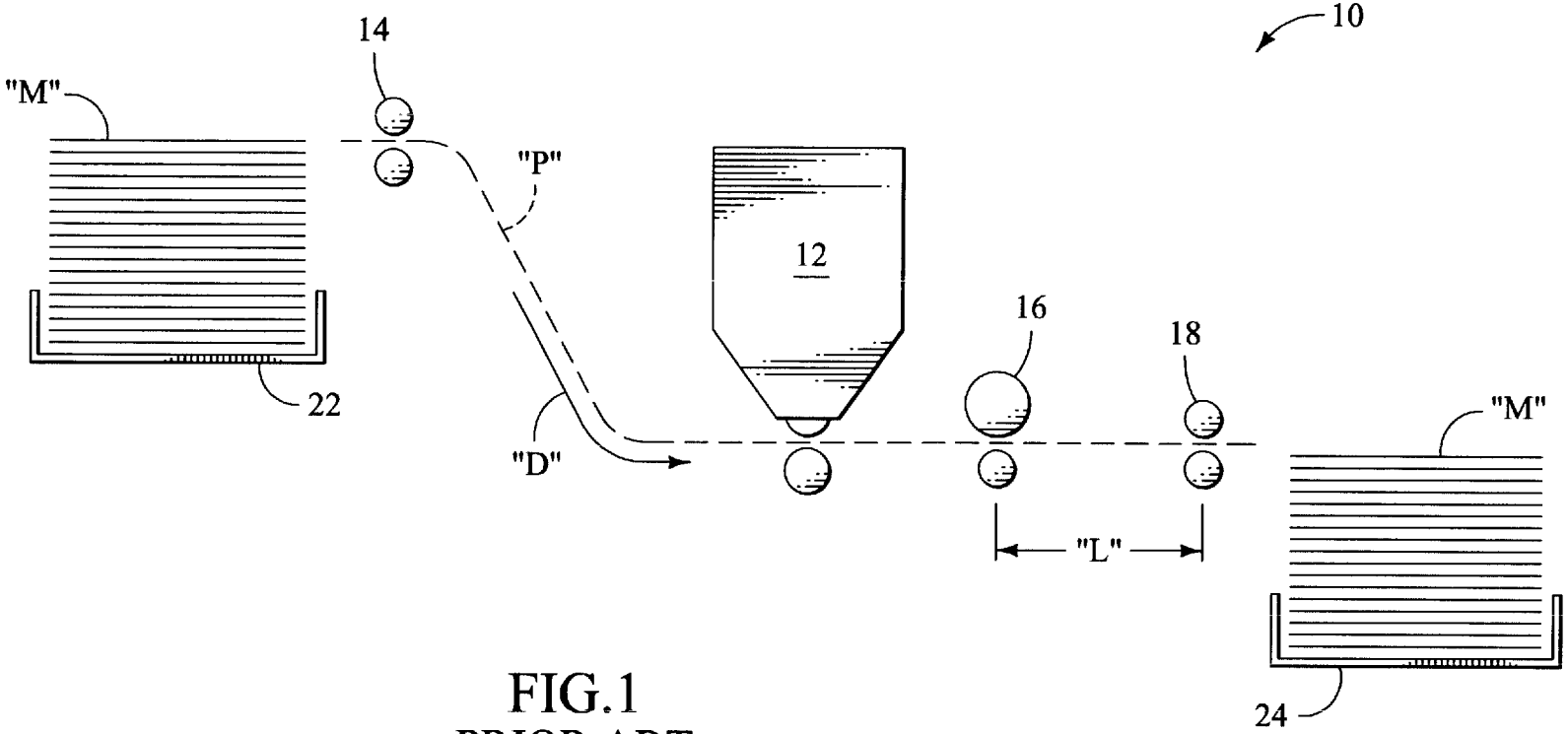
FIG.1 PRIOR ART
FIG. 1 is a side elevation schematic diagram of a prior art imaging apparatus.
Figure 2:
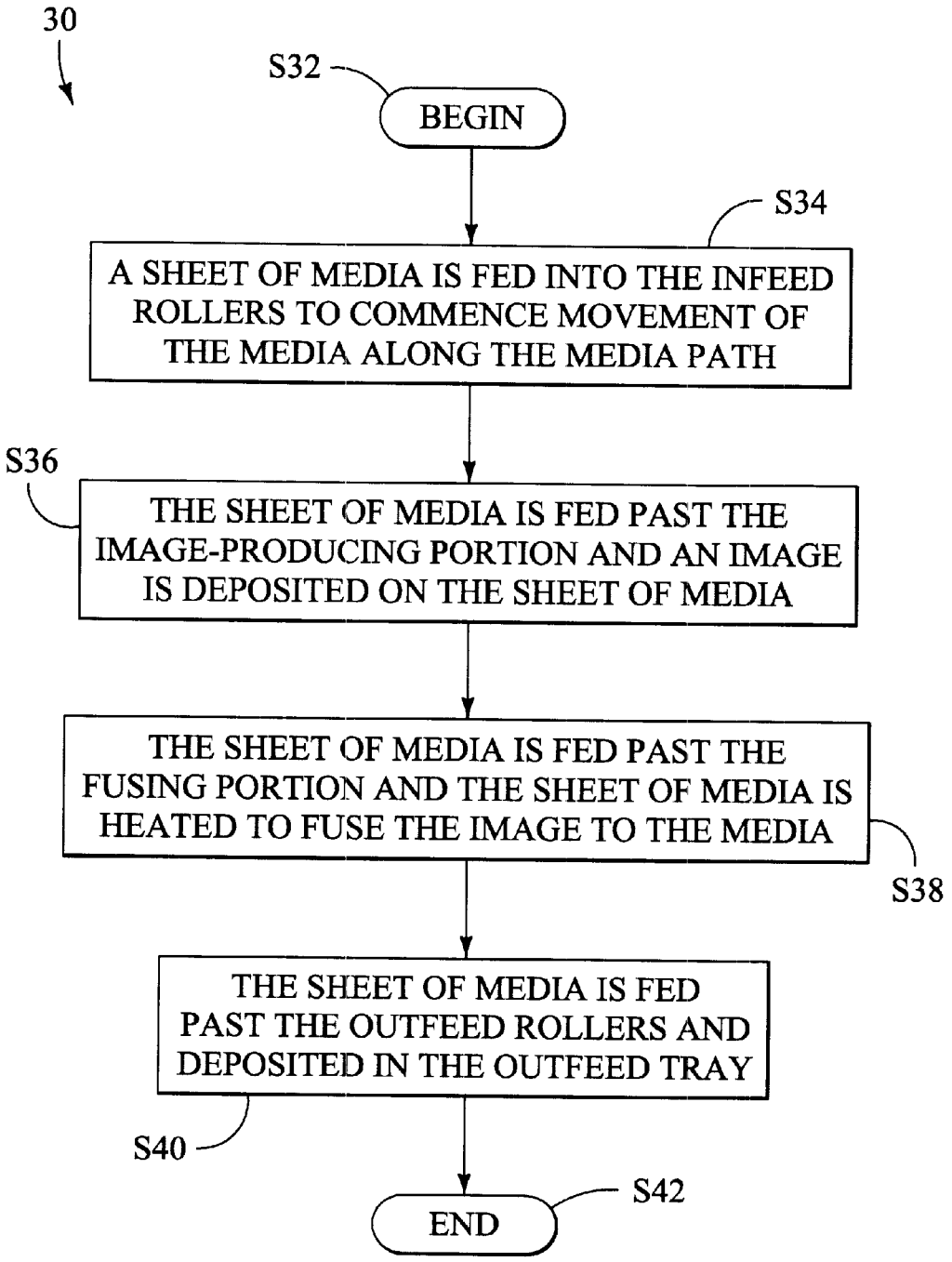
FIG.2 PRIOR ART
FIG. 2 is a flow chart which contains a set of prior art steps for operating the prior art apparatus depicted in FIG. 1.
Figure 3:
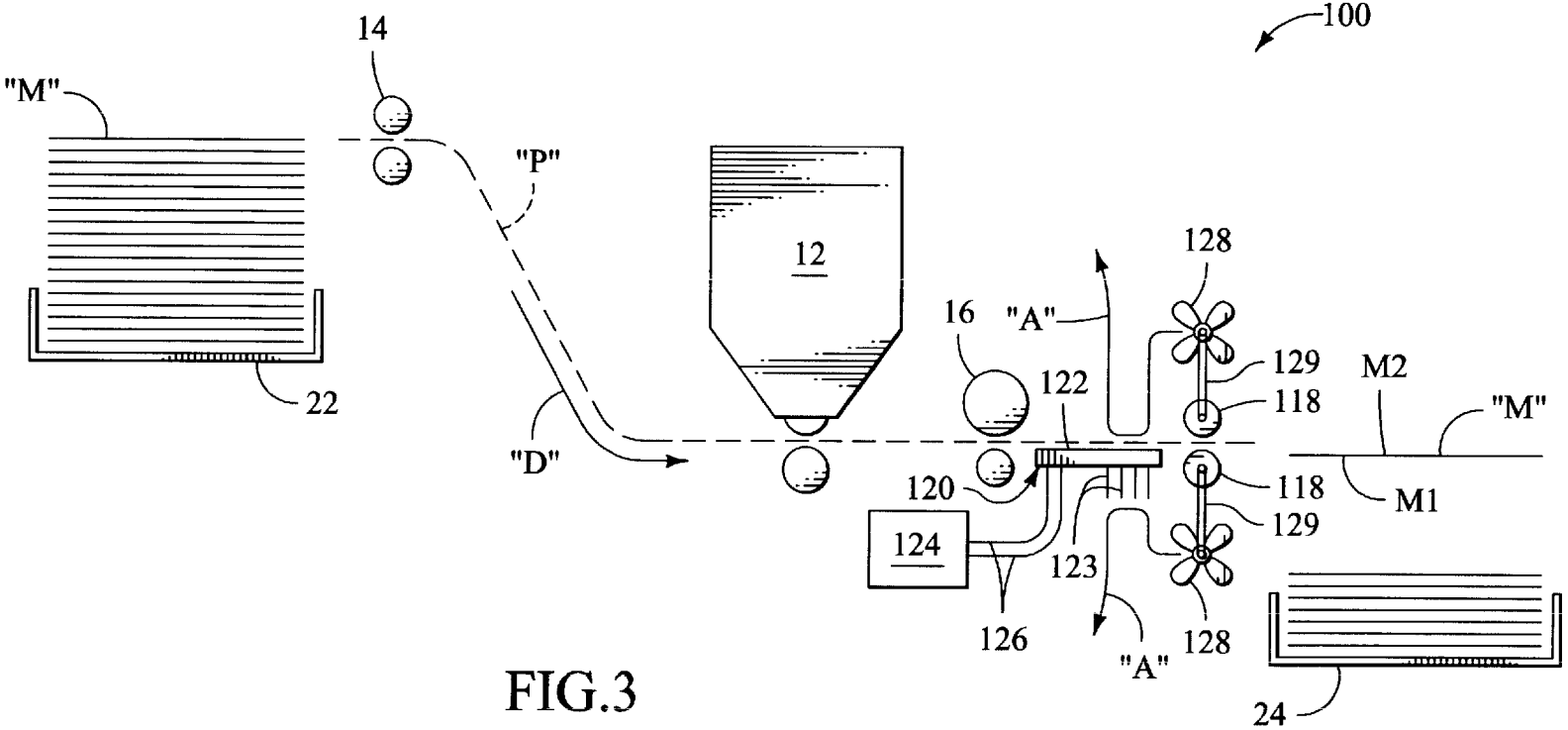
FIG. 3 is a side elevation schematic diagram of an imaging apparatus in accordance with a first embodiment of the present invention.

Referring now to FIG. 3, a side elevation schematic view is shown which depicts an imaging apparatus 100 in accordance with a first embodiment of the present invention. The imaging apparatus 100 is configured to operate in a manner similar to that of the prior art imaging apparatus 10 as described above for FIGS. 1 and 2. That is, as is evident from a study of FIG. 3, the imaging apparatus 100 can comprise an infeed tray 22, a set of infeed rollers 14, an image-producing portion 12, a fusing portion 16, and an outfeed tray 24.

The infeed tray 22 of the apparatus 100 is configured to support at least one sheet of media "M." The set of infeed rollers 14 are configured to move a sheet of media "M" in a feed direction "D" along a media path "P" and toward the image-producing portion 12. The image-producing portion 12 is configured to deposit toner in the form of an image onto a sheet of media "M" as described above for the prior art apparatus 10. A media feed system (not shown), or the like, is preferably included in the apparatus 100 in order to move the media "M" along the media path "P" in the feed direction "D." It is understood that such media feed systems are known in the art and will not be discussed herein.

As described above for the prior art apparatus 10, the fusing portion 16 is configured to fuse the toner, which makes up the image, to the sheet of media "M" by heating the media and/or the toner. The outfeed tray 24 is configured to support at least one sheet of media "M" after the image is fused to the media. The operation and configuration of these components has been described above with respect to the prior art apparatus 10.

The apparatus 100 can also comprise a set of outfeed rollers 118 which are configured to move a sheet of media "M" into the outfeed tray 24. As is apparent, the set of outfeed rollers 118 can be configured so as to operate in a manner which is substantially similar to that of the set of outfeed rollers 18 of the prior art apparatus 10 which is described above. However, the set of outfeed rollers 118 of the apparatus 100 can also be configured to have additional functions and features.

For example, the apparatus 100 can comprise at least one fan assembly 128 which is driven by at least one of the outfeed rollers 118. That is, the apparatus 100 can also comprise at least one drive linkage 129 for each fan assembly 128 included in the apparatus. Preferably, each drive linkage 118 is connected to the outfeed rollers 118 and to the fan assembly 128 as depicted, wherein the fan assembly is linked in power-transmitting connection with the outfeed rollers. When we say "in power-transmitting connection" we mean connected so as to facilitate the transmission of mechanical power there between.

Thus, if a given fan assembly 128 and the outfeed rollers 118 are linked in power-transmitting connection, then the rotation of the outfeed rollers is transmitted to the given fan assembly to cause operation thereof. The drive linkages 129 can be configured as one of the many different types of drive linkages known in the art. For example, the drive linkages 129 can comprise an endless drive belt with pulleys, an endless drive chain with sprockets, a gear train, a drive shaft or the like.

As an alternative to the inclusion of the drive linkages 129 in the apparatus 100, the fan assemblies 128 can be operated byway of a mechanical power source such as an electric motor (not shown) or the like. That is, alternatively, the fan assemblies 128 can be driven by an electric motor rather than by the rotation of the outfeed rollers 118, by way of the drive linkages 129. This configuration would allow the fan assemblies 128 to operate independently of the drive rollers 118.

As yet a further study of FIG. 3 reveals, the apparatus 100 comprises a cooling device 120 which is preferably located substantially proximate the media path "P" and is also preferably located substantially between the fusing portion 16 and the set of outfeed rollers 118. A cooling surface 122 is defined on the cooling device 120 as shown. The cooling surface 122 is configured to contact a sheet of media "M" as the media moves along the media path "P."

The cooling surface 122 is also configured to absorb heat energy from the sheet of media "M" as the media contacts the cooling surface. The transfer of heat energy from the media "M" to the cooling surface 122 can occur, for example, by known processes such as conduction and radiation. Such transfer of heat energy from the media "M" to the cooling surface 122 can serve to facilitate temperature reduction of the media. That is, the cooling device 120 can act as a heat sink to absorb spikes of heat energy, wherein each spike of heat energy corresponds to the passing of a sheet of media "M" past the cooling device. The heat energy can then be passively dissipated from the cooling device 120 to surrounding atmosphere, for example.

Preferably, however, air "A" can be induced to flow relative to the cooling device 120 to facilitate active dissipation of heat energy from the sheet of media "M." More preferably, the air "A" can be induced to flow by way of at least one fan assembly 128 which is described above. That is, air "A" can be directed at, or across, the media "M" as the media passes the cooling device 120 in order to facilitate dissipation of heat energy directly from the media and into the surrounding atmosphere, for example. Such cooling of the media "M" by way of the movement of air "A" there across can be accomplished by known processes such as convection, for example. This convective cooling by way of the flow of air "A" across, or at, the media "M" can be provided in addition to the conduction and radiation cooling afforded by absorption, by the cooling surface 122, of heat energy from the media "M."

Alternatively, or in addition, air "A" can be directed at, or across, the cooling device 120 in order to facilitate yet additional cooling of the media "M" by dissipating heat energy from the cooling device 120 and into the surrounding atmosphere after the heat energy has been collected from the media by the cooling device. To further facilitate dissipation of heat energy into the surrounding atmosphere, the apparatus 100 can comprise at least one cooling fin 123. Preferably, the cooling fin 123 is configured to project from the cooling device 120 generally as depicted.

Such cooling fins 123 can serve to increase the surface area of the cooling device 120 to facilitate the dissipation of heat energy from the cooling device to the atmosphere. Thus, the cooling fins 123 can assist in the passive dissipation of heat energy from the cooling device. Preferably, however, air "A" can be made to flow substantially across, or through, the cooling fins 123 to provide active heat dissipation from the cooling device 120.

The cooling device 120, as well as the cooling surface 122, fan assemblies 128, and cooling fins 123, are preferably fabricated from a material that demonstrates a relatively low resistance to the flow of thermal energy. For example, preferably, the cooling device 120, as well as the cooling surface 122, fan assemblies 128, and cooling fins 123, are fabricated from a material comprising aluminum. More preferably, the cooling device 120, as well as the cooling surface 122, fan assemblies 128, and cooling fins 123, are fabricated from a material comprising copper. Fabricating such components from materials having low resistance to thermal conductivity can facilitate conduction of heat energy throughout the various portion of the cooling device 120, thus increasing the rate of heat dissipation there from.

As a further study of FIG. 3 reveals, the apparatus 100 can comprise a coolant circulation system 124. The coolant circulation system can be connected to the cooling device 120 by way of coolant lines 126. When we say "coolant circulation system" we mean a system that circulates a fluid coolant through a given object for the purpose of absorbing and removing heat energy from the given object. When we say "fluid coolant" we mean any fluid that is capable of absorbing heat energy from the cooling device 120 and carrying the heat energy away from the cooling device for dissipation there from.

For example, the coolant circulation system 124 can be a simple system that is configured to circulate a coolant such as water or air through the cooling device 120. Moreover, the coolant circulation system 124 can include at least a portion of a refrigeration system, or the like, which uses a fluid coolant such as Freon, or the like, and which causes the fluid coolant to substantially evaporate within the cooling device 120 so as to absorb heat energy, and which also causes the coolant to substantially condense outside of the cooling device 120 so as to release heat energy outside of, and away from, the cooling device.

Still referring to FIG. 3, it is seen that a sheet of media "M" which has been moved past the set of outfeed rollers 118 has a first side M1 and an opposite second side M2. Any given sheet of media "M" is either a simplex-printed sheet, or a duplex-printed sheet. When we say, "simplex-printed" we are referring to a sheet of media "M" that bears an image only on one side. When we say "duplex-printed" we are referring to a sheet of media "M" that bears an image on both sides.

On a simplex-printed sheet of media "M," the first side M1 is defined for the purposes herein as the non-printed side. Likewise, the second side M2 is defined as the printed side. When we say "printed side" we mean the side of a simplex-printed sheet of media "M" that bears an image. When we say "non-printed side" we mean the side of a simplex-printed sheet of media "M" that does not bear an image. That is, on a simplex-printed sheet of media "M," the first side M1 is the non-printed side which is blank, and the opposite second side M2 is the printed side which bears an image thereon.

Similarly, on a duplex-printed sheet of media "M," the first side M1 is the first-printed side, and the second side M2 is the second-printed side. When we say "first-printed side" we mean the side on the duplex-printed sheet of media "M" which first receives an image thereon. When we say "second-printed side" we mean the side of the duplex-printed sheet of media "M" which receives an image after the first-printed side. In other words, the first-printed side receives an image before the second-printed side.

That is, the first side M1 is also the first-printed side on a duplex-printed sheet of media "M" which receives an image before the second-printed side receives an image. The second side M2 is also the second-printed side on a duplex-printed sheet of media "M" which receives an image after the first-printed side receives an image. Simplex and duplex imaging apparatus and methods are known in the art and will not be discussed in detail. However, the discussion in the paragraph which immediately follows is provided as a basic explanation of simplex and duplex imaging methods.

Generally, a simplex-printed sheet of media "M" passes the image-producing portion 12 once to receive an image, and is then moved into the outfeed tray 24. Conversely, a duplex-printed sheet of media "M" generally passes the image-producing portion 12 a first time to receive an image on the first-printed side, and is then turned over and passes the image-producing portion a second time to receive an image on the second-printed side.

Still referring to FIG. 3, the cooling surface 122 is preferably configured to contact the non-printed side, or the first side M1, of a simplex-printed sheet of media "M." Likewise, in the case of a duplex-printed sheet of media "M," the cooling surface 122 is preferably configured to contact the first-printed side M1. That is, the apparatus 100 is preferably configured such that, when a simplex-printed sheet of media "M" is produced, the non-printed side M1 contacts the cooling surface 122, and when a duplex-printed sheet of media "M" is produced, the first-printed side M1 contacts the cooling surface. This can serve to reduce the probability that an image will be smudged by contact with the cooling surface 122.

Figure 4:
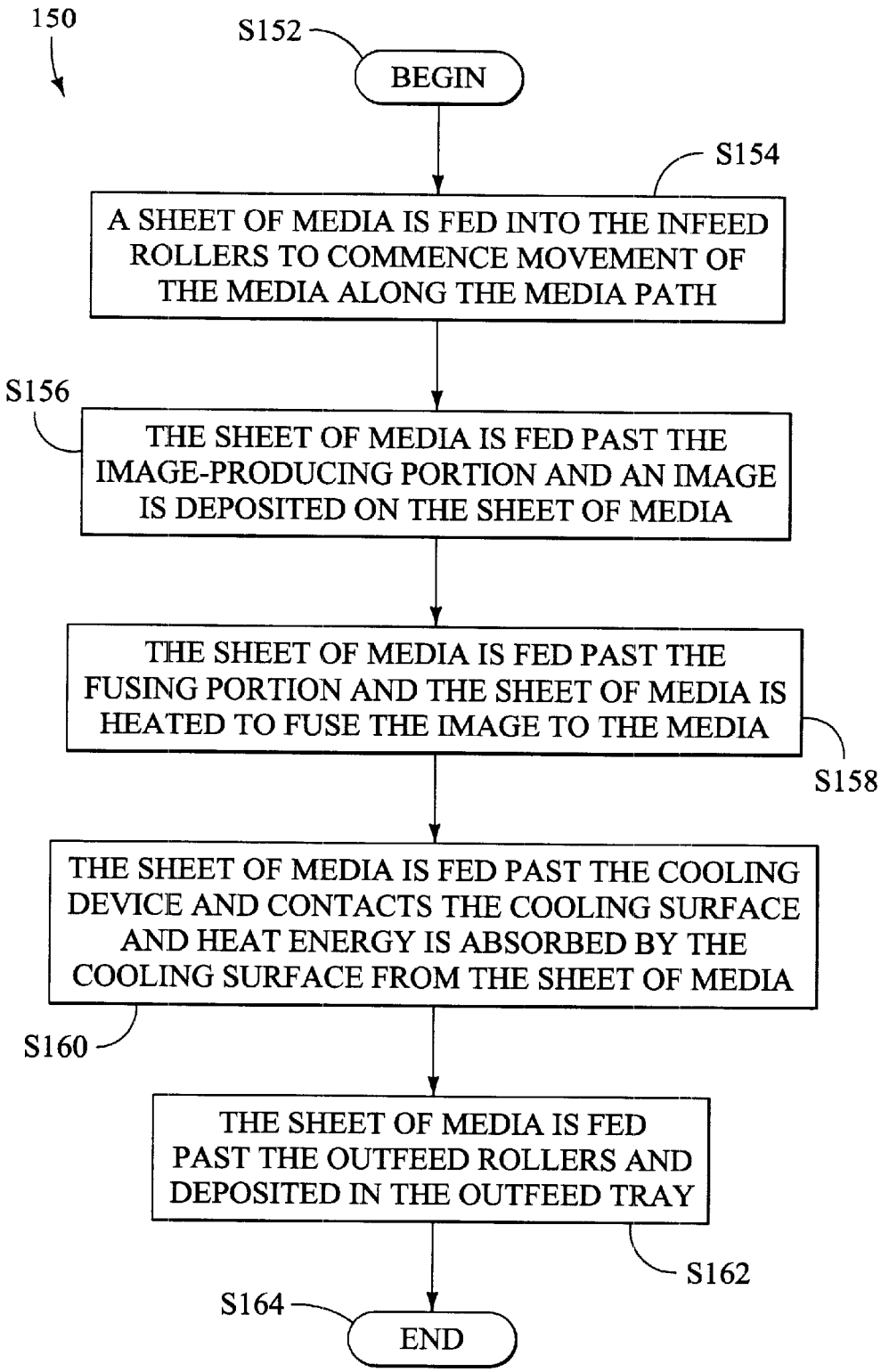
FIG. 4 is a flow chart which contains a set of steps for operating the apparatus depicted in FIG. 3.

Moving now to FIG. 4, a flow chart 150 is shown which depicts a series of steps in accordance with the present invention which can be used to describe the typical operational processes performed on a given sheet of media "M" by the apparatus 100 during the production of a finished image. The various steps of which the flow chart 150 is comprised will be discussed with reference to both FIGS. 3 and 4. The beginning of the flow chart 150 is denoted by step S152. In accordance with step S154, a sheet of media "M" is fed into the infeed rollers 14 in order to commence the movement of the sheet of media along the media path "P" in the feed direction "D."

Moving to step S156, the sheet of media "M" is fed past the image-producing portion 12 and an image comprising toner is deposited on the sheet of media. The next step is that of S158, in accordance with which the sheet of media "M" is fed past the fusing portion 16, whereupon the sheet of media is heated to a relatively high temperature in order to fuse the image to the media. The sheet of media "M" is then fed, in accordance with step S160, past the cooling device 120, whereupon the media contacts the cooling surface 122. During contact of the media "M" with the cooling surface 122, heat energy is transferred from the media to the cooling device to facilitate lowering the temperature of the media. Moving now to step S162, the sheet of media "M" is fed past the outfeed rollers 118 and is deposited in the outfeed tray 24. The next step of S164 is the end of the flow chart 150.

As is evident, the imaging apparatus 100 as equipped with the cooling device 120 can provide advantages over similar prior art apparatus which are not so equipped with a cooling device of the present invention. Furthermore, it is understood that many different cooling device configurations are possible which serve the purpose of the invention as set forth herein. An additional embodiment of the present invention will now be discussed below which illustrates but one more of the many possible configurations of a cooling device in accordance with the present invention which can serve the purpose contemplated thereby.

Figure 5:
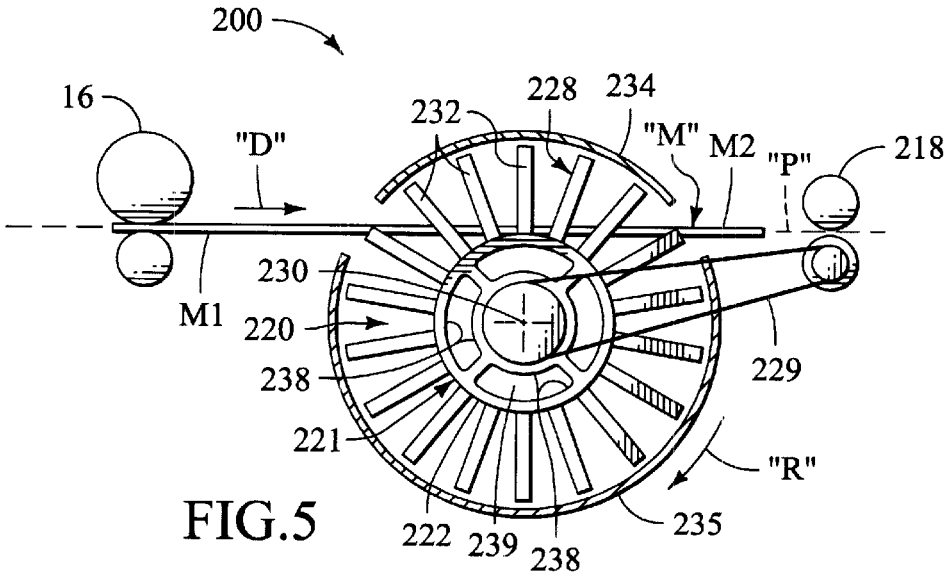
FIG. 5 is a side elevation view of an imaging apparatus in accordance with a second embodiment of the present invention.

Moving now to FIG. 5, a side elevation view is shown which depicts an apparatus 200 in accordance with a second embodiment of the present invention. Certain components which can be included in the apparatus 200 and which can also be included in the apparatus 100 discussed above, such as the infeed and outfeed trays, and the image-producing portion, have been omitted from FIG. 5 in the interest of clarity, and to avoid redundant explanation and illustration of such components which can be common to all embodiments of the instant invention discussed herein.

However, certain other items which can be common to all embodiments of the instant invention which are discussed herein have been included and shown in FIG. 5 for reference. For example, the apparatus 200 can comprise a fusing portion 16 which is configured to function as discussed above for the apparatus 100. In addition, the apparatus 200 can comprise a set of outfeed rollers 218 which are configured to function in manners similar to those of the outfeed rollers 118 of the apparatus 100 discussed above.

The media path "P" is also shown and the feed direction "D" is indicated. As is also seen, a sheet of media "M" is shown as positioned along the media path "P." As discussed above, the media "M" has a first side M1 which is a non-printed side of a simplex-printed sheet of media, and which is a first-printed side in the case of a duplex-printed sheet of media. Similarly, the media "M" has a second side M2, which is opposite the first side M1, and which second side is the printed-side of a simplex-printed sheet of media. In the case of a duplex-printed sheet of media "M," the second side M2 is a second-printed side.

As is also seen, the apparatus 200 comprises a cooling device 220 which is configured to absorb heat energy from the sheet of media "M." That is, the cooling device 220 can act as a heat sink which is configured to absorb spikes of heat energy from the media "M," and then dissipate the heat energy into the surrounding atmosphere, for example, wherein each spike of heat energy corresponds to the passage of a sheet of media past the cooling device.

The cooling device 220 comprises a substantially cylindrical roller 221 which is rotatably mounted on a support such as a chassis, a frame, or the like (not shown). The cylindrical roller 221 is preferably configured to rotate about an axis of rotation 230, and is more preferably configured to rotate in a direction of rotation "R" about the axis of rotation.

As is seen, the cylindrical roller 221 can be configured to facilitate movement of the sheet of media "M" along the media path "P" in the feed direction "D." That is, the rotation of the cylindrical roller 221 in the direction "R" can serve to assist in moving the sheet of media "M" along the media path "P." Other guides and the like can be added to assist in moving the media "M" along the media path. However, it is understood that such additional items are known in the art and have been omitted because they are not germane to the discussion herein.

The apparatus 200 comprises a cooling surface 222 which is defined on the cylindrical roller 221. As is evident, the cooling surface 222 is substantially cylindrical in shape. The apparatus 200 additionally comprises a fan assembly 228. The fan assembly 228 is preferably mounted on the cylindrical roller 221 and is also preferably configured to rotate therewith about the axis of rotation 230. The fan assembly 228 comprises a plurality of fan blades 232 which preferably extend substantially radially from the cylindrical roller 221.

The fan assembly 228 can be configured in the manner of a traditional fan, wherein the fan assembly rotates so as to cause movement of air substantially in a given direction. That is, the fan assembly 228 can be configured for the primary purpose of moving air in a given direction as in a traditional configuration of a fan. It is understood, however, that alternatively, the fan assembly 228 can be configured for the primary purpose of dissipating heat energy. That is, in this alternative configuration, the fan assembly 228 is configured such that the primary purpose of the fan blades 232 is to act as cooling fins so as to dissipate heat energy there from. In other words, an alternative primary purpose of the fan assembly is not to move air, but to move the fan blades 232 through the air in order to promote convective dissipation of heat energy there from to the surrounding air.

Preferably, the fan assembly 228 is shrouded by an upper fan shroud 234 and a lower fan shroud 235 in order to increase the efficiency of the fan assembly. The cooling device 220 preferably defines at least one cavity 239 which can facilitate cooling of the cooling surface 222. For example, the cylindrical roller 221 can be substantially hollow as shown so as to define the cavity 239 therein. Also, the cylindrical roller 221 can define at least one opening 238 which leads to the cavity 239. The openings 238 can allow cooling fluid, such as air or the like, to circulate within the cavity 239 in order to facilitate the dissipation of heat energy from the cooling surface 222 to the surrounding atmosphere.

The apparatus 200 can comprise a drive linkage 229, or the like, which is connected to the set of outfeed rollers 218 and to the cylindrical roller 221, wherein the cylindrical roller is linked in power-transmitting connection with the outfeed rollers. That is, the drive linkage 229 transmits mechanical power to the cylindrical roller 221 so that rotation of the outfeed rollers 218 causes a corresponding rotation of the cylindrical roller, and vice versa.

The drive linkage 229 allows the cooling device 220 to draw operational mechanical power from the outfeed rollers 218. This eliminates the requirement for a dedicated mechanical power supply, such as a motor or the like, for the operation of the cooling device 220. Many variations of drive linkages are known in the art and the drive linkage 229 can be any of a number of known configurations including a drive belt and pulleys, a drive chain and sprockets, a gear train, a drive shaft, or the like.

Alternatively, the drive linkage 229 can be omitted from the apparatus 200, wherein the cylindrical roller 221 can be configured to rotate about the axis of rotation 230 by action of the media "M" against the cylindrical roller as the media moves along the media path "P" in the feed direction "D." Such rotation of the cylindrical roller 221 by movement of the media "M" can also cause operation of the fan assemblies 228 in the case wherein such fan assemblies are included in the apparatus 200. As yet a further alternative, the fan assemblies 228 can be configured so as to be independently rotatable with respect to the cylindrical roller 221. In such a case, the fan assemblies 228 are preferably driven by way of the drive linkage 229, or by way of a mechanical power source such as an electric motor (not shown), or the like, As is evident from a study of FIG. 5, the media "M" moves in the feed direction "D" along the media path "P." Such movement of the media "M" can be caused by action of a media feed system or the like which is not shown, but which is known in the art and which shall not be discussed further herein. As the media "M" moves along the media path "P," the media comes into contact with the cooling surface 222 of the cooling device 220. Preferably, the first side M1 of the media "M" contacts the cooling surface 222. As the media "M" contacts the cooling device 220, the cylindrical roller 221, and the fan assembly 228, preferably rotate in the direction "R" about the axis of rotation 230. The rotation of the cylindrical roller 221 can assist in moving the media "M" along the media path "P" in the feed direction "D."

As described above, the media "M" is heated to a relatively high temperature by the fusing portion 16 in order to fuse images to the media. As the media "M" passes the cooling device 220, heat energy is transferred from the media to the cooling device so as to cause a decrease in temperature of the media prior to the passage of the media through the outfeed rollers 218 and before exit of the media from the apparatus 200. The transfer of heat energy from the media "M" to the cooling device 220 can be accomplished by processes which include conduction and radiation, for example.

That is, the cooling device 220 can act as a heat sink, wherein heat energy can be conducted and/or radiated from the media "M" to the cooling device 220 when the media contacts, or nears, the cooling surface 222. The heat energy is then conducted throughout the cooling device 220 to the various portions and components thereof. The heat energy, after being conducted throughout the cooling device 220, can then be dissipated there from to the surrounding atmosphere and/or other surrounding objects.

Further cooling of the media "M" can be accomplished by the circulation of air across the media, the cooling surface 222, and the fan blades 232, as well as through the cavity 239. That is, as the cylindrical roller 221 rotates in the direction "R" about the axis of rotation 230, the fan assembly 228 also rotates about the axis to induce the flow of air. Such a flow of air can cause cooling of the media "M," as well as the cooling device 220 by processes which include convection and radiation, for example. That is, as air at substantially ambient temperature is circulated across the media "M," the cooling surface 222, the fan blades 232, and through the cavity 239, heat energy can be absorbed by the air through the process of convection and/or radiation, whereupon the heat energy is then dissipated to the atmosphere.

Figure 6:
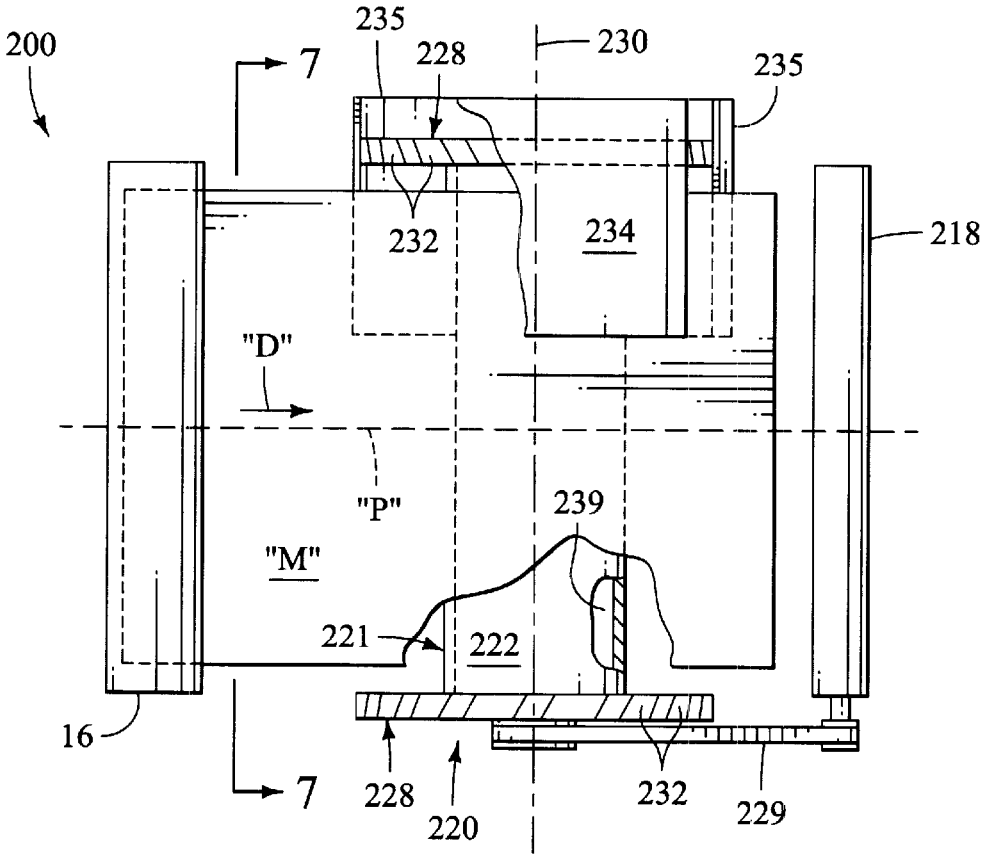
FIG. 6 is a top view of the imaging apparatus depicted in FIG. 5.

Moving now to FIG. 6, a top cutaway view is shown of the apparatus 200 which is depicted in FIG. 5. Although the cooling device 220 can comprise only a single fan assembly 228, preferably two such fan assemblies are included, wherein one fan assembly is mounted at each end of the cylindrical roller 221, as shown. As is also seen, the media path "P" preferably appears to be substantially perpendicular to the axis of rotation 230 when viewed from above the cooling device 220 as shown.

As is further seen, only one of the fan assemblies 228 is shown to be shrouded by a set of fan shrouds which comprises the upper fan shroud 234 and lower fan shroud 235. Although, preferably, both fan assemblies 228 are shrouded by the upper shroud 234 and lower shroud 235, it is understood that only one fan assembly is depicted as shrouded herein in order to prevent unnecessary cluttering of the figure.

When viewing the cooling device 220 as depicted in FIG. 6, the uppermost, or closest, surface in the view is that of the upper shroud 234. The upper shroud 234 is shown to be cut away to partially reveal one of the fan assemblies 228. The lower shroud 235 can be seen to be below both the upper shroud 234 and the fan assembly 228 which is shrouded thereby. The sheet of media "M" is seen to be located between the upper shroud 234 and the lower shroud 235.

The sheet of media "M" is also shown to be cut away to reveal the cylindrical roller 221 and the cooling surface 222 which are located beneath the sheet of media. The cooling surface 222 is cut away to reveal the cavity 239 defined by the cylindrical roller 221. As is seen, a view 7—7 is taken from a location between the fusing portion 16 and the cooling device 220. As also seen, the view 7—7 is taken in the same direction as the feed direction "D."

Figure 7:
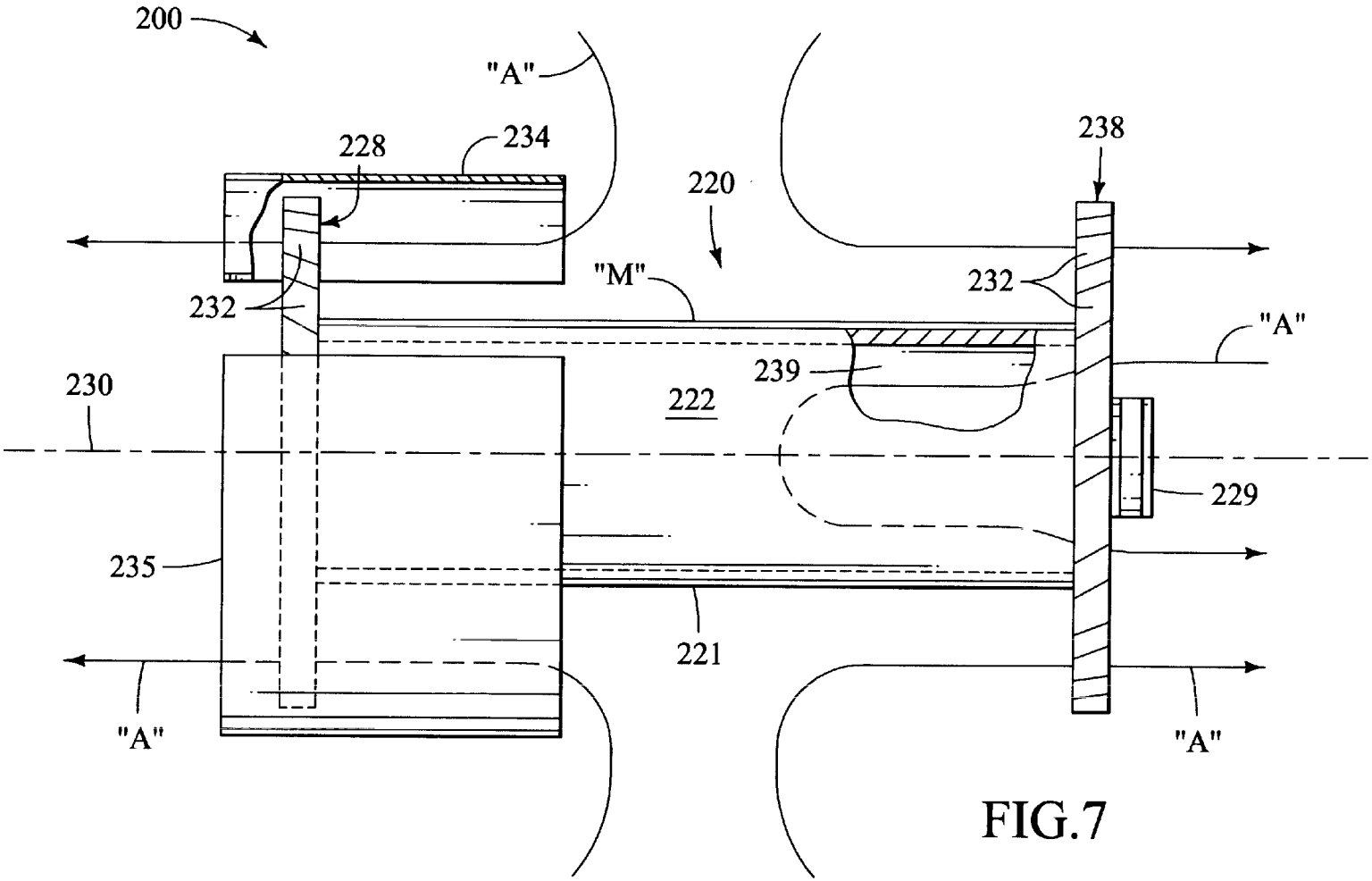
FIG. 7 is a view in the feed direction of the apparatus depicted in FIG. 6.

Now referring to FIG. 7, the view 7—7 is shown which depicts the cooling device 220 along with the upper and lower shrouds 234, 235, respectively. As is evident, the upper shroud 234 is shown to be cut away to reveal a portion of one of the fan assemblies 228. The view provided in FIG. 7 can be particularly well-suited for depicting the flow of air "A" across both the media "M" and the cooling surface 222 which can be induced by the fan assemblies 228.

As discussed above, the cylindrical roller 221 is configured to be rotated about the axis of rotation 230. This rotation of the cylindrical roller 221 can be accomplished by way of the drive linkage 229 when the outfeed rollers 218 are rotating. Each of the fan assemblies 228 can be mounted on the cylindrical roller 221 in which case the fan assemblies are made to rotate about the axis of rotation 230 along with the cylindrical roller. As is evident, the fan assemblies 228 are preferably axial fan assemblies which are configured to move air "A" in a substantially axial direction which is substantially parallel to the axis of rotation 230.

More preferably, the fan assemblies 228 are configured to move air "A" in a substantially outward direction relative to the cylindrical roller 221. That is, each fan assembly 228 preferably moves air "A" in an outward direction which is substantially away from the other fan assembly. As is seen, the fan assembly 228 which is shrouded pulls air "A" in between the upper shroud 234 and the sheet of media "M."This air "A" moves substantially across the media "M" and through the fan blades 232. The flow of air "A" in this manner can facilitate cooling of the media "M" as well as dissipation of heat energy from the fan blades 232 which, in turn, is conducted to the fan blades from the cylindrical roller 221, which in turn, absorbs the heat energy from the media.

As also seen, the fan assembly 228 which is shrouded pulls air "A" in between the lower shroud 235 and the cylindrical roller 221. This air "A" moves substantially across the cylindrical roller 221 and through the fan blades 232. The flow of air "A" in this manner can serve to further dissipate heat energy from the cooling device 220 by absorbing and removing heat energy from the cylindrical roller 221 and the fan blades 232. Air "A" can also circulate within the cavity 239 defined by the cylindrical roller 221. The circulation of air "A" within the cavity 239 can provide yet further dissipation of heat energy from the cooling device 220.

Thus, as the sheet of media "M" moves in the feed direction "D" along the media path "P," the media passes through the fusing portion 16 which heats the media to a relatively high temperature. The media "M" continues along the media path "P" to the cooling device 220 whereupon the media contacts the cooling surface 222 which is defined on the cylindrical roller 221. The cylindrical roller 221 is made to rotate about the axis of rotation 230 in the direction "R" which serves to assist movement of the media "M" along the media path in the feed direction "D."

Moreover, the rotation of the cylindrical roller 221 causes the rotation of the fan assemblies 228. The rotation of the fan assemblies 228 cause air "A" to flow through the fan assemblies and about the media "M" and the cooling surface 222 to facilitate dissipation of heat energy therefrom and into the surrounding atmosphere. That is, as the media "M" contacts the cooling surface 222, heat energy can be conducted and can also be radiated from the media to the cooling surface. The heat energy is then conducted through out the cylindrical roller 221 and to the fan blades 232. The movement of air "A" across the fan blades 232 and across the cooling surface 222 serves to dissipate the heat energy from the fan blades and cooling surface into the surrounding atmosphere.

Thus, as the media "M" moves along the media path "P," the temperature of the media can be passively or actively reduced by way of the respective passive and active cooling processes described above as the media passes through the cooling device 220. After the media "M" passes the cooling device 220, the media then proceeds through the outfeed rollers 218 which serve to propel the media out of the apparatus 200 and into an outfeed tray (not shown) or the like for retrieval by a user of the apparatus.

In accordance with a third embodiment of the present invention, a method includes various steps for actively cooling a sheet of media before the media exits an imaging apparatus wherein the image is deposited on, and fused to, the media. The method comprises providing a cooling surface and causing the sheet of media to contact the cooling surface. Heat energy is transferred from the sheet of media to the cooling surface during contact there between. The transfer of heat energy from the sheet of media to the cooling surface can be accomplished by processes which include radiation and/or conduction, for example.

The method of cooling a sheet of media can also include transferring heat energy from the cooling surface to the surrounding atmosphere. Additionally, a stream of air can be directed substantially across the sheet of media to absorb heat energy there from by processes which include radiation and/or convection, for example. Likewise, a stream of air can be directed substantially across the cooling surface to similarly absorb and remove heat energy therefrom.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging apparatus including a cooling device, the cooling device comprising:

a cylindrical roller rotatably supported by the imaging apparatus;

a cooling surface defined on the roller; and, a plurality of substantially radial fins protruding outwardly from the cooling surface.

2. The imaging apparatus of claim 1, and wherein:

the imaging apparatus defines a media path configured to convey therealong a sheet of media bearing an image thereon; and, the media path is at least partially continuous with the cylindrical roller, whereby the sheet of media contacts the surface while being conveyed along at least a portion of the media path.

3. The imaging apparatus of claim 2, and wherein the plurality of fins are configured to move air across the sheet of media when the cylindrical roller is rotated.

4. The imaging apparatus of claim 2, and wherein the plurality of fins are configured to move air across the sheet of media when the cylindrical roller is rotated and while the sheet of media is in contact with the cooling surface.

5. The imaging apparatus of claim 2, and wherein:

the plurality of fins are configured to move air across the sheet of media when the cylindrical roller is rotated; and, the air is moved in a direction substantially transverse to the media path.

6. An imaging apparatus including a cooling device, the cooling device comprising:

a cylindrical roller rotatably supported by the imaging apparatus;

a cooling surface defined on the roller;

a shroud supported by the imaging apparatus in spaced-apart juxtaposed relation to the cooling surface; and, a media path defined by the apparatus and configured to convey therealong a sheet of media bearing an image, wherein at least a portion of the media path is located between the shroud and the cooling surface, whereby the sheet of media contacts the cooling surface when conveyed along at least a portion of the media path.

7. The imaging apparatus of claim 6, and further comprising a fan configured to move air across the sheet of media and between the shroud and the cooling surface.

8. The imaging apparatus of claim 7, and wherein the fan comprises a plurality of substantially radial fins protruding outwardly from the cooling surface.

9. The imaging apparatus of claim 7, and further comprising a drive linkage operatively connected to the cylindrical roller and to the fan, thereby rotationally linking the cylindrical roller and the fan in power-transmitting connection to one another.

* * * * *